US005669978A

United States Patent [19]

Brown

[11] Patent Number: 5,669,978

[45] Date of Patent: Sep. 23, 1997

[54] METHOD FOR REMOVING SCALE FROM SILVER ARTICLES USING AN AQUEOUS OXALIC ACID SOLUTION

[76] Inventor: Mattie L. Brown, 244 Robinson, Shreveport, La. 71104

[21] Appl. No.: 498,024

[22] Filed: Jul. 3, 1995

[51] Int. Cl.[6] ..... B08B 3/12; C23G 1/02

[52] U.S. Cl. ..... 134/1; 134/3; 134/28; 134/41

[58] Field of Search ..... 134/1, 3, 25.2, 134/28, 33, 41; 148/252; 252/79.4

[56] References Cited

U.S. PATENT DOCUMENTS

| | | | |
|---|---|---|---|
| 674,254 | 5/1901 | Arthur | 134/42 |
| 1,428,084 | 9/1922 | Gravell | 134/41 X |
| 1,554,483 | 9/1925 | Bailey et al. | 134/28 |
| 1,954,745 | 4/1934 | Peterson et al. | 134/3 |
| 2,326,837 | 4/1943 | Coleman | 134/41 X |
| 2,420,262 | 5/1947 | Navaretta | 134/3 |
| 2,585,616 | 2/1952 | Barnes | 134/3 |
| 2,631,950 | 3/1953 | Rosenfeld et al. | 134/3 |
| 3,116,177 | 12/1963 | Cerma et al. | 148/6.14 |
| 3,166,444 | 1/1965 | Ehren et al. | 134/3 |
| 3,345,217 | 10/1967 | Wollgien et al. | 148/6.15 |
| 3,450,577 | 6/1969 | Beach | 148/6.15 |
| 3,468,804 | 9/1969 | Perry | 134/41 |
| 3,481,883 | 12/1969 | Streicher | 134/3 |
| 4,116,713 | 9/1978 | Otrhalek et al. | 134/3 |
| 4,452,643 | 6/1984 | Martin et al. | 134/3 |
| 4,617,063 | 10/1986 | Morris et al. | 134/6 |

FOREIGN PATENT DOCUMENTS 90-22024 of 1992 Japan .

OTHER PUBLICATIONS

J.C. Warner "Corrosion of Metals and Alloys," Chemistry of Engineering Materiaals, pp. 404–405 (1942).

Materials Handbook, 12th Ed. McGraw–Hilll Inc., pp. 735–736, 738–739 (1986).

A Concise Encyclopedia of Metallurgy, American Elsevier Publishing Co., Inc., pp. 658–659, 712–713, 888–889 (1965).

Metals Handbook, Desk Edition, ASM, pp. 29.2, 29.6–29.7, 29.12–29.14, 29.42, 29.44–29.45, 29.47, 29.52 (1985).

The Merck Index, 11th Ed., Merck & Co., Inc., p. 1093 (1989).

Encyclopedia of Chemical Technology, vol. 15, 3rd Ed., John Wiley & Sons, pp. 300–301; vol. 16, 3rd Ed., pp. 618–620, 627, 629–633 (1981).

Encyclopedia of Chemical Technology, vol. 9–Errata, Interscience Publishers, pp. 4, 6, 7 (1952).

*Primary Examiner*—Jill Warden

*Assistant Examiner*—Saeed Chaudhry

*Attorney, Agent, or Firm*—Pravel, Hewitt, Kimball & Krieger

[57] ABSTRACT

A silver pickling method employing aqueous oxalic acid solutions that removes tightly adherent scale at room temperature, as well as elevated temperatures, that does not tend to plate contaminants onto silver articles due to the accumulation of copper ions in a pickle solution, and that does not aggressively attack solder joints is provided. The silver pickling method comprises the steps of contacting the surface scale of a silver article, such as jewelry, with a solution of oxalic acid and water; maintaining the solution contact with the surface scale for a period of time sufficient to loosen the scale; and removing the surface scale from the article.

26 Claims, No Drawings

METHOD FOR REMOVING SCALE FROM SILVER ARTICLES USING AN AQUEOUS OXALIC ACID SOLUTION

FIELD OF THE INVENTION

The present invention relates to methods for pickling nonferrous metals with acid solutions, and more specifically to pickling methods for silver and silver alloy articles that employ aqueous oxalic acid solutions.

BACKGROUND OF THE INVENTION

During the manufacture of nonferrous metal articles, high temperature heat processes, such as casting, soldering, welding, and annealing are employed. These processes can result in the formation of a layer of oxides on the article's surface. These oxides include lightly adherent oxides, such as those caused on silver article by soldering, as well as tightly adherent scale caused during casting of silver articles. The term "scale," as used herein, refers to the tightly adherent layer, or layers, of metal oxides that are formed.

Abrasion, grinding, sanding, wire brushing, blasting and pickling methods are employed in the metal industries to loosen and remove tightly adherent scale. The pickling methods involve placing the article in a heated acidic solution (such as nitric, hydrochloric, hydrofluoric, chromic, and sulfuric), for a period of time sufficient to loosen the scale, which is subsequently removed by mechanical means.

A distinction, that is somewhat a matter of degree, exists between acid pickling and acid cleaning of metal articles. Acid pickling is a more severe and aggressive treatment for the removal of oxides, such as scale, and contaminants, such as burned on soldering residue from semi-finished articles. Acid cleaning, on the other hand, refers to the use for final or near-final preparation of metal surfaces.

The use of acid solutions in pickling scale in the ferrous metal finishing industry is well-known. U.S. Pat. No. 2,585,616 to Barnes describes a method of pickling iron scale with an aqueous solution containing sodium bisulfate or sulfuric acid or hydrochloric acid along with oxalic acid at its solubility limit, and solid oxalic acid. U.S. Pat. No. 2,631,950 to Rosenfeld et al. describes an aqueous solution, for removing iron rust and scale from metal surfaces, that contains oxalic acid and a hydrolyzable chloride of a trivalent metal.

The scale which forms on silver-containing metal articles as a result of heat processing is particularly adherent. In the silver finishing industry, pickling of this tightly bonded scale is typically achieved using granular sodium bisulfate, $HNaO_4S$, in solution with water. Acidic solutions, such as heated aqueous sulfuric acid or nitric acid, are also used. Although the proportions can vary, a sodium bisulfate based silver pickle is commonly prepared as a mixture of 2½ lbs. of granular sodium bisulfate to 1 gallon water. The resulting solution is used as a heated pickle at a temperature in the range from about 57° C. to about 95° C.

Nitric and hot sulfuric acid silver pickles have the drawback of being overly aggressive toward the silver articles themselves, which are soluble in these acids. For example, silver is attacked by boiling 60% sulfuric acid at the rate of 0.88 mm per year and is rapidly dissolved at room temperature by nitric acid.

While sodium bisulfate based acidic pickling solutions provide for acceptable scale removal from silver articles, they nevertheless have significant and numerous drawbacks.

The use of sodium bisulfate solutions that have been contaminated with ferrous metals, including contamination resulting from contact with stainless steel, can lead to the plating of a pinkish layer of contaminants onto the surface of the silver article. In addition, when sodium bisulfate solutions are used to pickle sterling silver articles that include copper as an alloying element (sterling silver contains a minimum of 92.5% silver alloyed with other metals, most typically copper) the accumulation of copper ions in the solution can lead to the plating of copper onto the sterling silver surface. When ferrous contamination of sodium bisulfate solutions occurs, or when the accumulation of copper ions in the solution reaches the point where plating occurs, the solution must be replaced, with accompanying expense. With sodium bisulfate pickles, the accumulation of copper ions occurs fairly quickly resulting in routine and frequent solution replacement. In addition, any articles that were contaminated must undergo subsequent additional processing to remove the contaminant by buffing, tumbling, or cleaning.

An additional problem with sodium bisulfate based pickle solutions is that they can be overly aggressive on small or delicate soldered joints, such as the links of silver chain. Typical silver solders contain from 9% to 80% silver alloyed with copper, cadmium, tin, lead, and other metals. Very low temperature solders may contain even less silver, for example, one commercially available low temperature solder with a melting point of 221° C. contains 4% silver and 96% tin. Sodium bisulfate based pickle solutions aggressively attack the non-silver portion of the solder and can thus destroy the integrity of the solder joint. Solders that contain a smaller percentage of silver are more susceptible to such attack than those with a higher percentage. Repeated pickling using sodium bisulfate solutions can therefore easily result in damage to soldered joints.

Many acid pickles, including sodium bisulfate solutions, require handling with special acid-resistant implements, gloves and other equipment. Commercially available pickle pots employ removable acid-resistant plastic baskets, which must be carefully monitored while in a pickle pot, as the baskets can easily melt if left in the heated solution too long or if the solution level is not sufficiently high.

The acid mists that are produced from heated sulfuric acid pickle solutions can, if not limited, create considerable health and environmental problems. Long-term exposure to sulfuric acid mist may cause dermatitis, respiratory problems (including chronic bronchitis), and teeth etching.

In the metal finishing industry, mechanical mass finishing is widely practiced with tumbler machines using centrifugal, vibratory, and rotary actions. In these machines, the articles to be finished are placed in a tumbler drum or cavity along with an unheated mixture of solid media (such as porcelain, carbon steel, stainless steel, ceramic, and plastic) and tumbler solution.

Tumbler silver pickling is not presently possible because commercially available tumblers are unheated and conventional silver pickling solutions require a heated solution to be effective. In addition, commercially available pickles typically are not compatible with many of the above-mentioned tumbler solid media.

Still desired is a silver pickling method which loosens and removes the most tightly bonded scale on silver articles to the same degree as heated sodium bisulfate solutions while not requiring the use of heated solutions with their associated acid mists, does not tend to plate contaminants on the article surface due to accumulation of copper ions in a pickle solution, is not easily contaminated by ferrous metals arising from stainless steel in a pickle solution, can be practiced in conjunction with mass tumbler finishing, is compatible with plastics that are less acid resistant than the plastics required for use with sodium bisulfate, and which does not attack typical soldered joints as aggressively as sodium bisulfate pickle.

SUMMARY OF THE INVENTION

The present invention provides a silver pickling method employing aqueous oxalic acid solutions that removes tightly adherent silver scale at room temperature, as well as elevated temperatures; that is not easily contaminated with ferrous metals due to contact with stainless steel in a pickle solution; that does not easily tend to plate contaminants due to the presence of accumulated copper ions in a pickle solution; that does not require that the articles be handled with highly acid-resistant plastic items; that can be used unheated in conjunction with a tumbler; and that does not attack soldered joints as aggressively as sodium bisulfate solutions.

The silver pickling method comprises the steps of contacting the surface scale of a silver article with a solution of oxalic acid and water; maintaining the solution contact with the surface scale for a period of time sufficient to loosen the scale; and removing the surface scale from the article.

The oxalic acid and water solution can be prepared using any suitable source of oxalic acid, such as oxalic acid dihydrate ($C_2H_2O_4.2H_2O$) or anhydrous oxalic acid ($C_2H_2O_4$), or by using any suitable combination of chemicals that results in a solution of oxalic acid and water.

DETAILED DESCRIPTION OF PREFERRED EMBODIMENT

The pickling method of the present invention comprises the basic step of contacting a silver article with an aqueous solution of oxalic acid. The oxalic acid solution is preferably, but not limited to, a mixture of oxalic acid dihydrate and water or a mixture of anhydrous oxalic acid and water.

An acceptable range of the temperature of the aqueous oxalic acid solution is from about 15° C. to about 100° C. Although unheated room temperature solutions, in the range from about 15° C. to about 28° C., are most preferred in order to reduce the production of acid mists and enable the use of unheated tumblers, if desired a thermally assisted solution can be employed to accelerate the pickling action. A preferable temperature range for heated solutions is from about 57 ° C. to about 95° C. Limiting the upper temperature to 95° C. avoids excess water loss from the solution.

Acceptable scale removal can be obtained with the present inventive method across a range of oxalic acid concentrations. In an unheated solution embodiment, the preferred range of oxalic acid dihydrate is from about 1 gram to about 14 grams dissolved in 100 ml of water. If a heated solution is used, the upper limit of the amount of oxalic acid dihydrate is determined by the solubility of oxalic acid dihydrate in water at a given temperature.

The contacting, and the maintaining of contact, of the silver scale with the oxalic acid solution may be accomplished by any of the techniques typically employed in the metal finishing industry, such as immersion in a static or ultrasonic bath, dipping, spraying, rotary tumbler mass finishing machines, vibratory mass finishing machines, or centrifugal mass finishing machines.

Defoaming agents may also be used in the oxalic acid solution to control foam build-up when pickling in a tumbler. A defoaming agent is not needed when the solution is used as a heated or unheated pickle in a typical static pickle pot or ultrasonic device.

Depending on the character and severity of the scale, the contact maintaining time that is sufficient to loosen the scale will vary from about one minute to greater than about 15 minutes. In most cases, when a solution concentration of about 10 grams of oxalic acid dihydrate dissolved in about 100 ml water is employed, about 5 minutes heated, or about 15 minutes unheated is sufficient for the oxalic acid solution to pickle the article thoroughly. The time required to pickle silver scale depends on both the amount and type of scale, as well as the concentration and temperature of the oxalic acid solution, with higher concentrations of acid and higher temperatures requiring less time.

Subsequent to maintaining contact of the silver scale with the oxalic solution for the requisite time, the pickled scale is removed by buffing, tumbling, cleaning, or any of the ordinary methods employed to remove pickled scale. Any scale that still remains is then repickled by the aforementioned process.

The oxalic acid pickle solutions employed in the present invention do not aggressively attack soldered joints in silver articles. This benefit makes it possible to leave articles with soldered joints in the solution for long periods of time without the risk of excessive attack. The compatibility of the oxalic acid solution with stainless steel and non-acid resistant plastic is also a unique and desirable characteristic of the method.

An additional benefit of employing oxalic acid solutions in the present method for pickling silver-containing articles is that oxalic acid is less aggressive in attacking silver than many other commonly used acid pickles. As mentioned in the background section, boiling 60% sulfuric acid attacks silver at the rate of 0.88 mm per year while nitric acid rapidly attacks silver at room temperature. In comparison, boiling oxalic acid attacks silver at a rate of less than 0.05 mm per year.

The oxalic acid solution employed in the present invention has a reduced tendency to plate copper onto a silver article resulting from accumulated copper ions present during pickling. This reduced tendency to plate copper results in an increased longevity of the solution in comparison to sodium bisulfate based pickles.

While the oxalic acid solution employed in the present method, as with sodium bisulfate based pickles, will plate contaminants onto the surface of the articles being pickled when the solution becomes contaminated by ferrous metals, both heated and unheated oxalic acid solutions are much less reactive with stainless steel than hot sodium bisulfate pickles. Stainless steel reacts immediately with hot sodium bisulfate pickles, immediately contaminating the solution and causing the unwanted plating reaction. Room temperature oxalic acid solution pickle does not react visibly with stainless steel and does not result in the depositing of any visible films or layers onto the silver article. A hot oxalic acid pickle, when contaminated by contact with stainless steel, only results in a slight dulling film on the surface of the pickled silver articles.

The method can be used on a wide range of silver-containing metal articles including, but not limited to, sterling silver articles, jewelry such as bracelets, necklaces, earrings, brooches, pins, cuff links, belt buckles, tie tacks, money clips, watch components, belt ornaments, buttons, and rings, tableware and silverware, such as, plates, bowls, platters, and serving utensils, bulk silver-containing metal stock such as flat sheet stock, wire stock, and tubing, and silver dental alloy articles.

As used herein, the terms "silver-containing metal articles" and "silver articles" means articles that are made of either silver or a silver alloy or articles that are partially made of silver or a silver alloy.

The following examples are intended to illustrate the invention as described above and claimed hereinafter and are not intended to limit the scope of the invention in any way.

EXAMPLE 1

Unheated 10:100 Solution in a Pyrex Container

An 10:100 weight ratio oxalic acid solution was prepared by mixing 10 grams oxalic acid dihydrate, $C_2H_2O_4.2H_2O$, with 100 ml of water at room temperature and stirring until the oxalic acid dihydrate dissolved.

A sterling silver article, with tightly adherent scale on the surface as the result of previous casting operations, was immersed in the unheated oxalic acid solution that was contained in a Pyrex beaker lined pickle pot.

In approximately 15 minutes the scale on the surface of the article was pickled such that it could be removed by buffing with a cotton or felt buffing wheel using a pre-finish compound, such as tripoli, or a final finish compound. The size of the buffing wheel used for scaling was in the range from about ⅛"×¾" to about 1"×6".

EXAMPLE 2

Unheated 1:100 Solution in a Pyrex Container

An oxalic acid solution was prepared by mixing 1 gram oxalic acid dihydrate, $C_2H_2O_4.2H_2O$, with 100 ml water (i.e. a 1:100 weight ratio) at room temperature and stirring until the oxalic acid dihydrate dissolved.

A sterling silver article, with tightly adherent scale on the surface as the result of previous casting operations, was immersed in the unheated oxalic acid solution in a Pyrex beaker lined pickle pot.

In approximately 45 to 60 minutes the scale on the surface of the article was pickled such that it could be removed by buffing with a cotton or felt buffing wheel using a pre-finish compound, such as tripoli, or a final finish compound. The size of the buffing wheel used for scaling was in the range from about ⅛"×¾" to about 1"×6".

EXAMPLE 3

Unheated 10:100 Solution in Plastic Container

Pickling was carried out by the method of example 1, with the exception that the pickling was conducted in a high density polyethylene plastic container.

The scale was pickled in approximately 15 minutes with no visible affect of the unheated oxalic acid solution on the plastic container. The solution was stored in the container for three months with no visible deterioration of the container.

EXAMPLE 4

Unheated 10:100 Solution in a Stainless Steel Container

Pickling was carried out by the method of example 1, with the exception that the pickling was conducted in a stainless steel container.

The scale was pickled in approximately 15 minutes. No visible residue deposited on the sterling article, as would occur with a hot sodium bisulfate pickle in a stainless steel container.

EXAMPLE 5

Ultrasonic Pickling

An 10:100 weight ratio oxalic acid solution was prepared by mixing 40 grams oxalic acid dihydrate, $C_2H_2O_4.2H_2O$, with 400 ml water at room temperature and stirring until the oxalic acid dihydrate dissolved.

A sterling silver article, with tightly adherent scale on the surface as the result of previous casting operations, was immersed in the unheated oxalic acid solution contained in a 600 ml Pyrex beaker. The beaker was then suspended in the center of a 2 quart stainless steel tank of a 60 watt, ½ amp, 120 volt ultrasonic bath filled with water. While the ultrasonic bath was not provided with an independent heater, the ultrasonic action itself is capable of heating the solution to 54° C.

Once the solution had been heated, by action of the ultrasonic, to 54° C., pickling of the sterling silver article took 5 to 8 minutes.

EXAMPLE 6

140° F. degree Heated Pickling

Pickling was carried out by the method of example 1, with the exception that the pickling was conducted in a pickle pot with heating. The solution was heated to about 60° C.

Pickling of the scale took place in 5 minutes.

EXAMPLE 7

Boiling 10:100 Solution in a Stainless Steel Container

Pickling was carried out by the method of Example 3, with the exception that the solution was heated to boiling and the article remained in the solution for one hour, although the scale was pickled in about 2 to 3 minutes. At the end of 1 hour, a dull thin grey film had been deposited on the silver surface. The silver surface itself was not dulled but appeared dull due to the presence of the film. The film was easily removed when the pickled scale was removed by polishing.

EXAMPLE 8

Boiling 10:100 Solution in a Pyrex Container

An 10:100 weight ratio oxalic acid solution was prepared by mixing 10 grams oxalic acid dihydrate, $C_2H_2O_4.2H_2O$, with 100 ml of water at room temperature and stirring until the oxalic acid dihydrate dissolved. The solution was placed in a Pyrex dish on an electric hot plate and brought to a boil.

A sterling silver article, with tightly adherent scale on the surface as the result of previous casting operations, was immersed in the boiling oxalic acid solution. The scale was pickled in about 2 to 3 minutes.

After maintaining the solution at a boil for 13 hours with the periodic addition of water to replace that lost due to the boiling, the solution maintained its ability to pickle normally in about 2 to 3 minutes.

EXAMPLE 9

Tumbler Pickling

A 10:100 weight ratio oxalic acid solution was prepared by mixing 50 grams oxalic acid dihydrate, $C_2H_2O_4.2H_2O$, with 500 ml water at room temperature and stirring until the oxalic acid dihydrate dissolved. The solution was placed in the 1½ gallon polymeric bowl of a 3000 RPM, 1/20 horsepower, vibratory tumbler. The inside of the bowl had a raised center that does not come into contact with the media or articles being tumbled. The vibratory action of the tumbler causes a constant spiraling action of the media which moves around the inside of the bowl while rotating from top to bottom. Plastic polyester media in the shape of pyramids of ½" to ¼", embedded throughout with fine abrasives were also placed in the bowl of the tumbler along with 50 pieces of 1¾"×1"×1/16" silver jewelry.

The jewelry was tumbled for 6 hours. As the solution pickled the scale, the lightly abrasive action of the tumbling media removed the pickled scale and exposed unpickled scale to the pickling solution. The use of the oxalic acid solution in the tumbler removed more scale than if ordinary tumbler fluid (for example, plain water or plain water and surfactant, or proprietary commercial tumbler fluids) had been used.

As the plastic pyramid media are slightly abrasive, they create residue in the tumbler fluid from sanding not only the articles being simultaneously pickled and tumbled but also themselves. This residue settled out of the solution upon storage for several hours. Retesting of the solution from which the sediment had been removed indicated that its pickling ability had not been affected.

EXAMPLE 10

Saturated Solution Pickling

A saturated solution was prepared by dissolving about 25 to about 28 grams of oxalic acid dihydrate in about 100 ml of heated water in a Pyrex beaker lined pickle pot.

A sterling silver article with scale was immersed in the heated solution. In about 30 seconds to about 2 minutes, the scale was pickled such that it could be removed by mechanical means as in Example 1. As water evaporates from the heated saturated solution over time, crystals form in the solution. The additional water necessary to redissolved the crystals was added.

EXAMPLE 11

Multiple articles, heated and unheated 10:100 solution

A 10:100 weight ratio oxalic acid solution was prepared by mixing 50 grams oxalic acid dihydrate, $C_2H_2O_4.2H_2O$, with 500 ml water at room temperature and stirring until the oxalic acid dihydrate dissolved.

20 to 40 sterling silver articles, with tightly adherent scale on the surface as the result of previous casting operations, was immersed in the oxalic acid solution in a Pyrex beaker lined pickle pot. The articles were pickled in about 15 minutes when a room temperature solution was used and in about 5 minutes when a solution at about 60° C. was employed.

EXAMPLE 12

Solder Joints; Comparison of Oxalic Acid and Sodium Bisulfate Based Pickles

Identical sterling silver charm bracelets with soldered chain links were pickled separately in hot solutions of oxalic acid and sodium bisulfate. Bracelets were pickled in each solution at a temperature between 57° C. and 95° C.

The sodium bisulfate pickle was produced by mixing 2½ lbs of granular sodium bisulfate with 1 gallon of water. The oxalic acid pickle was a 10:100 solution prepared as in Example 1. At the point when the sodium bisulfate had attacked all the soldered chain links and completely destroyed the structural integrity of the joints, the links of the identical bracelet in the oxalic acid solution maintained their structural integrity.

Although particular embodiments of the invention have been described in detail for purposes of illustration, various modifications may be made without departing from the spirit and scope of the invention. Accordingly, the invention is not to be limited except as by the appended claims.

What is claimed is:

1. A method for removing scale from a surface of a silver-containing metal article, the method comprising the steps of:

contacting surface scale of at least one silver-containing metal article with a solution consisting essentially of oxalic acid and water;

maintaining the contact of the surface scale with the solution for a period of time sufficient to loosen the scale; and removing the surface scale from the silver-containing metal article.

2. The method of claim 1, wherein the solution is prepared by combining oxalic acid dihydrate and water.

3. The method of claim 1, wherein the solution is prepared by combining anhydrous oxalic acid and water.

4. The method of claim 1, wherein the solution is prepared by combining oxalic acid dihydrate with water in a range from a weight ratio of about 1:100 to about a limit of oxalic acid dihydrate solubility in water.

5. The method of claim 1, wherein the solution is prepared by combining oxalic acid dihydrate with water in a weight ratio of about 10:100.

6. The method of claims 1, wherein the contacting and maintaining steps take place in a static bath.

7. The method of claims 1, wherein the contacting and maintaining steps take place in an ultrasonic bath.

8. The method of claim 1, wherein the contacting and maintaining steps take place in a machine selected from the group consisting of centrifugal mass finishing, vibratory mass finishing, and rotary tumbler mass finishing machines.

9. The method of claim 1, wherein the contacting and maintaining steps are accomplished by a technique selected from the group consisting of spraying and dipping.

10. The method of claim 1, wherein the contacting and maintaining steps take place in a tumbler.

11. The method of claim 1 or 6 or 7, wherein the solution is at a temperature in a range of about 15° C. to about 100° C.

12. The method of claim 1 or 6 or 7, wherein the solution is at a temperature in a range of about 15° C. to about 28° C.

13. The method of claim 1 or 6 or 7, wherein the solution is at a temperature in a range of about 57° C. to about 95° C.

14. The method of claim 1, wherein the silver-containing metal article is at least 92.5% silver.

15. The method of claim 14, wherein the silver-containing metal article is fabricated of at least 92.5% silver with remainder substantially copper.

16. The method of claim 1, wherein the silver-containing metal article is an article of jewelry.

17. The method of claim 16, wherein the jewelry is selected from the group consisting of bracelets, necklaces, earrings, brooches, pins, cuff links, belt buckles, tie tacks, money clips, watch components, belt ornaments, buttons, and rings.

18. The method of claim 16, wherein the jewelry has solder joints.

19. The method of claim 1, wherein the silver-containing metal article is an article of tableware.

20. The method of claim 19, wherein the tableware is selected from the group consisting of plates, bowls, platters, and serving utensils.

21. The method of claim 1, wherein the silver-containing metal article is silver stock.

22. The method of claim 21, wherein the silver stock is selected from the group consisting of flat sheet stock, wire stock, and tubing.

23. The method of claim 1, wherein the silver-containing metal article includes a silver dental alloy.

24. The method of claim 1, wherein the step of removing the surface scale from the article is accomplished by a process selected from the group consisting of buffing, tumbling, and cleaning.

25. A method for removing scale from a surface of a silver-containing metal article, the method comprising the steps of:

contacting surface scale of at least one silver-containing metal article with a solution consisting essentially of a defoaming agent, oxalic acid and water;

maintaining the contact of the surface scale with the solution in a tumbler for a period of time sufficient to loosen the scale; and removing the surface scale from the silver-containing metal article.

26. The method of claim 1, 8, 10, or 25, wherein the silver-containing metal article during the contacting and maintaining steps is further contacted with a solid media selected from the group consisting of stainless steel, ceramic, plastic, and porcelain media.

* * * * *